US007201616B2

(12) United States Patent
Smith

(10) Patent No.: US 7,201,616 B2
(45) Date of Patent: Apr. 10, 2007

(54) FUSE LINKED RELAY

(75) Inventor: Daniel Robert Smith, Farmington Hills, MI (US)

(73) Assignee: Hella Electronics Corporation, Plymouth, MI (US)

( * ) Notice: Subject to any disclaimer, the term of this patent is extended or adjusted under 35 U.S.C. 154(b) by 0 days.

(21) Appl. No.: 10/969,929

(22) Filed: Oct. 22, 2004

(65) Prior Publication Data

US 2006/0089050 A1 Apr. 27, 2006

(51) Int. Cl.
*H01R 4/48* (2006.01)

(52) U.S. Cl. ..... 439/830; 439/622; 439/76.2; 335/78

(58) Field of Classification Search ..... 439/830, 439/622, 76.2; 335/78
See application file for complete search history.

(56) References Cited

U.S. PATENT DOCUMENTS 5,362,242 A * 11/1994 Nakamura ..... 439/76.2
6,320,486 B1 11/2001 Dietrich et al.
6,585,541 B2 * 7/2003 Higashida et al. ..... 439/622
6,607,115 B2 * 8/2003 Kobayashi et al. ..... 228/101

FOREIGN PATENT DOCUMENTS

DE 32 09 915 A1 9/1983

* cited by examiner

*Primary Examiner*—Truc T. Nguyen
(74) *Attorney, Agent, or Firm*—Birch, Stewart, Kolasch & Birch, LLP

(57) ABSTRACT

A relay including a coil, a yoke having a first yoke leg and a second yoke leg, a first connector terminal being electrically connected to a first contact terminal, a second connector terminal being electrically connected to a second contact terminal via a movable contact terminal, and a fuse having, a first end portion and a second end portion. The first end portion and the second end portion of the fuse being fixedly and directly connected to the first contact terminal and the second contact terminal, respectively.

21 Claims, 7 Drawing Sheets

FUSE LINKED RELAY

BACKGROUND OF THE INVENTION

1. Field of the Invention

The present invention relates to a relay having a fuse fixedly and directly connected to the relay.

2. Description of the Background Art

More and more electronic devices are mounted on vehicles to enhance fuel economy, anti-pollution measures, drivability, comfortableness in an interior space, etc. Thus, there has been an increase in the number of relays and fuses that are provided in a vehicle fuse box in order to control and protect electrical components. As such, the vehicle fuse boxes become increasingly larger and more complex.

A fuse protects a circuit against damage caused by a short circuit or overcurrent. The link in the fuse will melt and burn in half to stop excess current and further circuit damage. A relay is an electrically operated switch. It allows a small dash switch to control another circuit by remote control, whereby the control comes from a distant point in the circuit.

FIG. 1 is an illustration of a conventional vehicle fuse box 1 that has a plurality of fuse receptacles 3 and relay receptacles 5 for receiving fuses 7 and relays 9, respectively, therein. As can be appreciated, because of the increasing electrical complexity of modern vehicles, the fuse box 1, as noted above, becomes increasingly larger.

DE3209915 and U.S. Pat. No. 6,320,486 each disclose, with reference to FIGS. 2 and 3, respectively, a relay 11 that has two additional connector tabs 13, 15 for removably receiving a melt plugable fuse 17. The arrangements shown in FIGS. 2 and 3 reduce the size of the conventional fuse box 1 because the fuse 17 is able to be plugged directly onto the relay 11, and thus the number of fuse receptacles 3 can be reduced. However, because the relay 11 is designed to use conventional type melt plugable fuses 17, a housing (not shown) of the relay 11 must take into consideration the dimensions of the fuse 17, and thus, a size of the relay 11 is in fact larger than conventional relays 9.

More importantly, because the melt plugable fuses 17 are inserted into the connector tabs 13, 15, heat is generated at contact points 19. In addition, because of current, the contact points 19 relax and degrade and therefore, even more heat is generated. Typically, approximately 1–1.5 watts of heat can be generated at each contact point.

For example, a typical vehicle fuse box 1 has approximately 20 relays and 20 fuses, whereby the fuses each have two contact points and the relays each have 4 contact points. Thus, there are 120 contact points that can generate 120–180 watts of heat. Because of the design of the relay 11 of the prior art, as shown in FIGS. 2 and 3, the generated heat is even more so concentrated in a smaller area on a fuse box than the conventional fuse box 1.

Furthermore, the prior art devices are prone to operator error. For example, if an operator inserts a 40 amp fuse into relay that is rated for 20 amps, the wrongly inserted fuse provides no protection for the relay or the circuit elements associated therewith, which can thus lead to the relay igniting and burning.

SUMMARY OF THE INVENTION

It is therefore an object of the present invention to provide a universal protected relay that generates less heat and is able to be designed in a compact size. The relay includes a coil, a yoke having a first yoke leg and a second yoke leg, a first connector terminal being electrically connected to a first contact terminal, a second connector terminal being electrically connected to a second contact terminal via a movable contact, and a fuse having a first end portion and a second end portion. The first end portion and the second end portion of the fuse are fixedly and directly connected to the first contact terminal and the second contact terminal, respectively.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
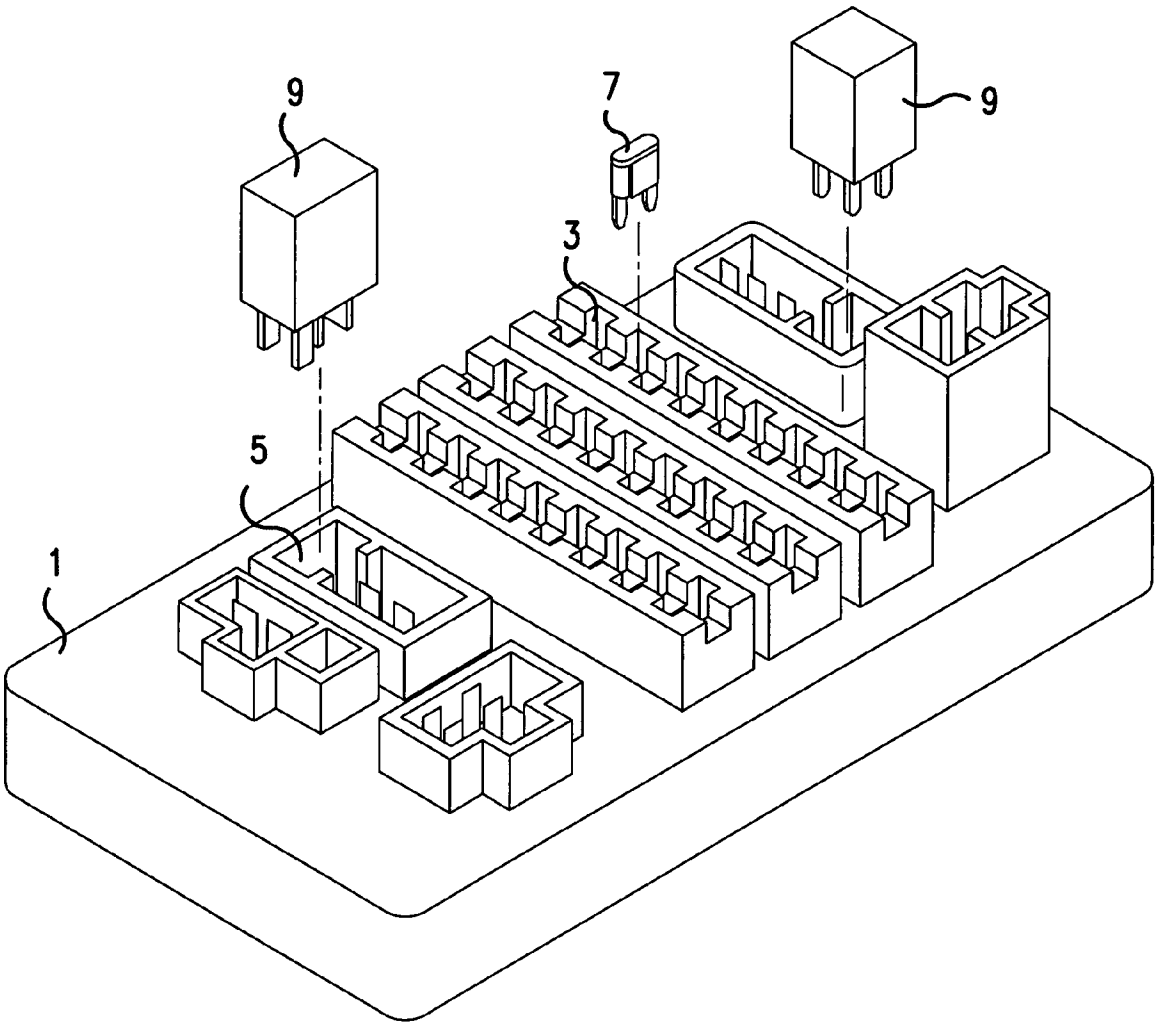
FIG.1 CONVENTIONAL ART
FIG. 1 is a schematic illustration of a conventional vehicle fuse box.
Figure 2:
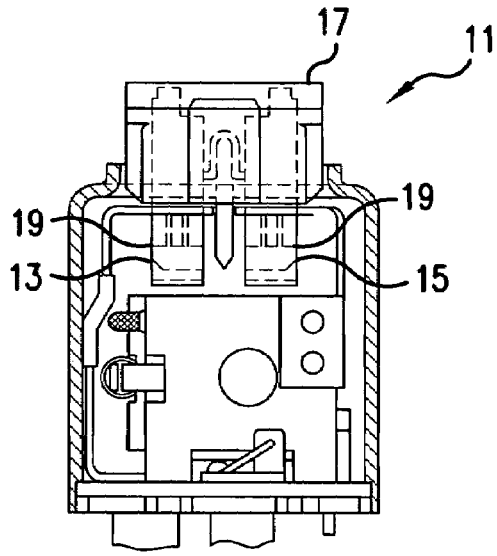
FIG.2 PRIOR ART
FIGS. 2 and 3 are illustrations of a prior art relay unit.
Figure 3:
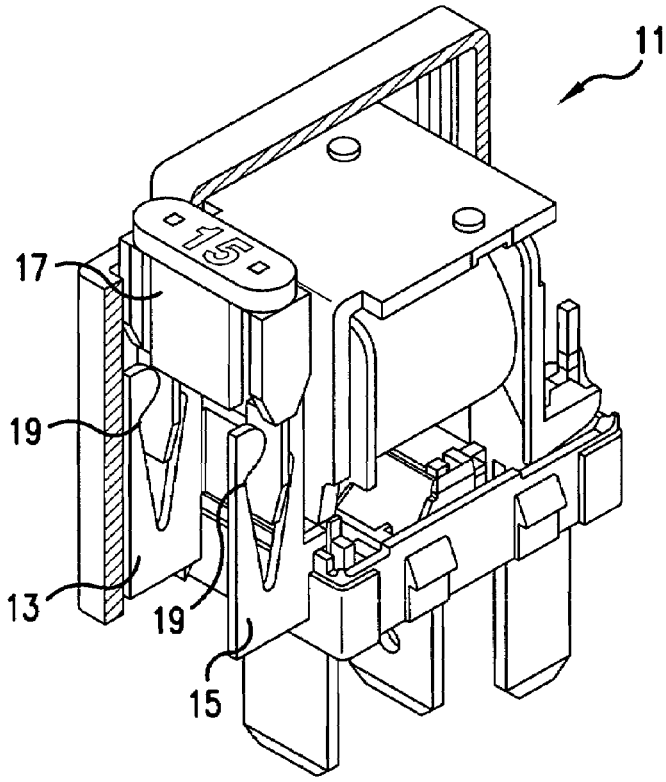
FIG.3 PRIOR ART
Figure 4:
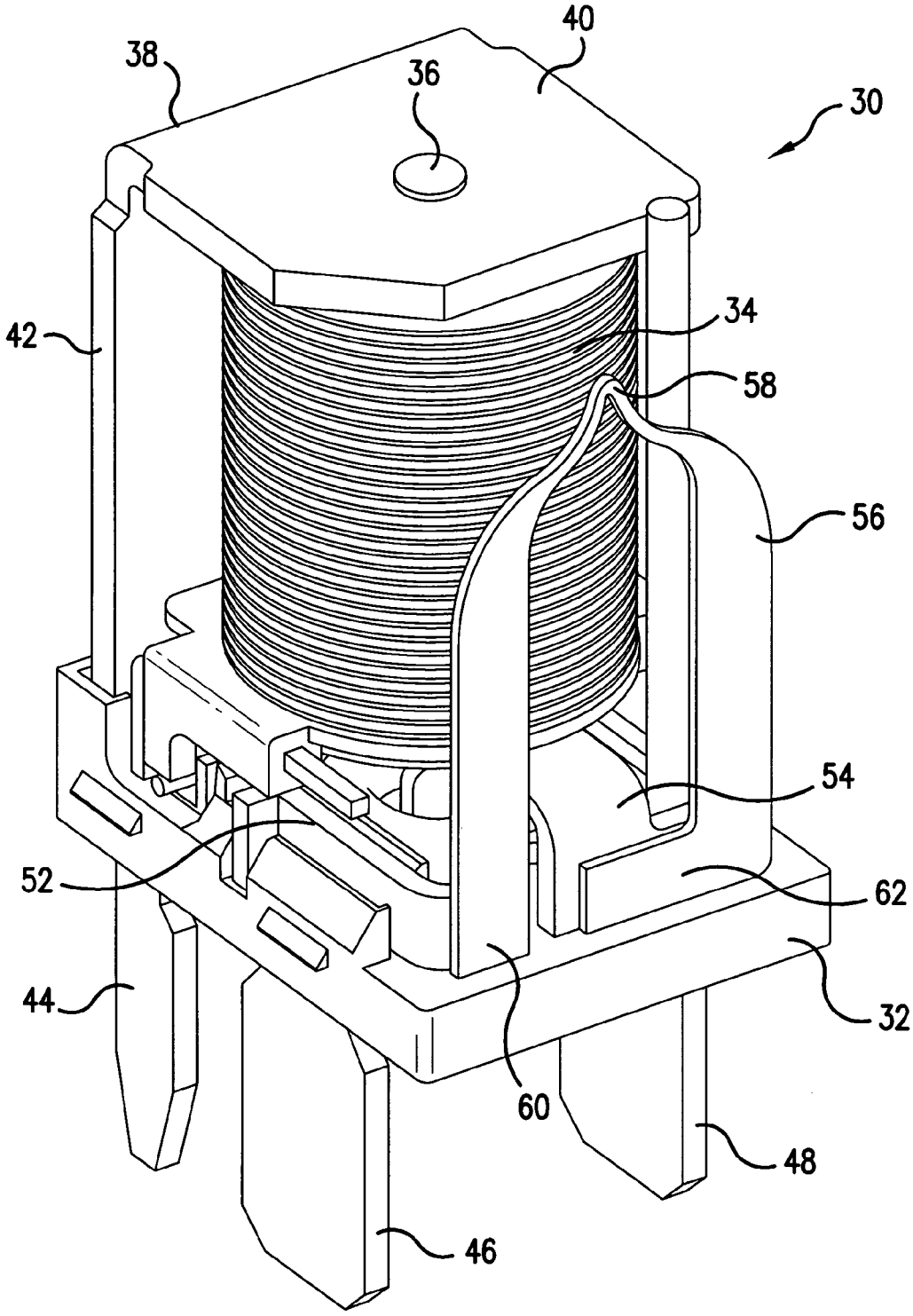
FIGS. 4 and 5 are perspective views of a fuse linked relay according to a preferred embodiment of the present invention.
Figure 5:
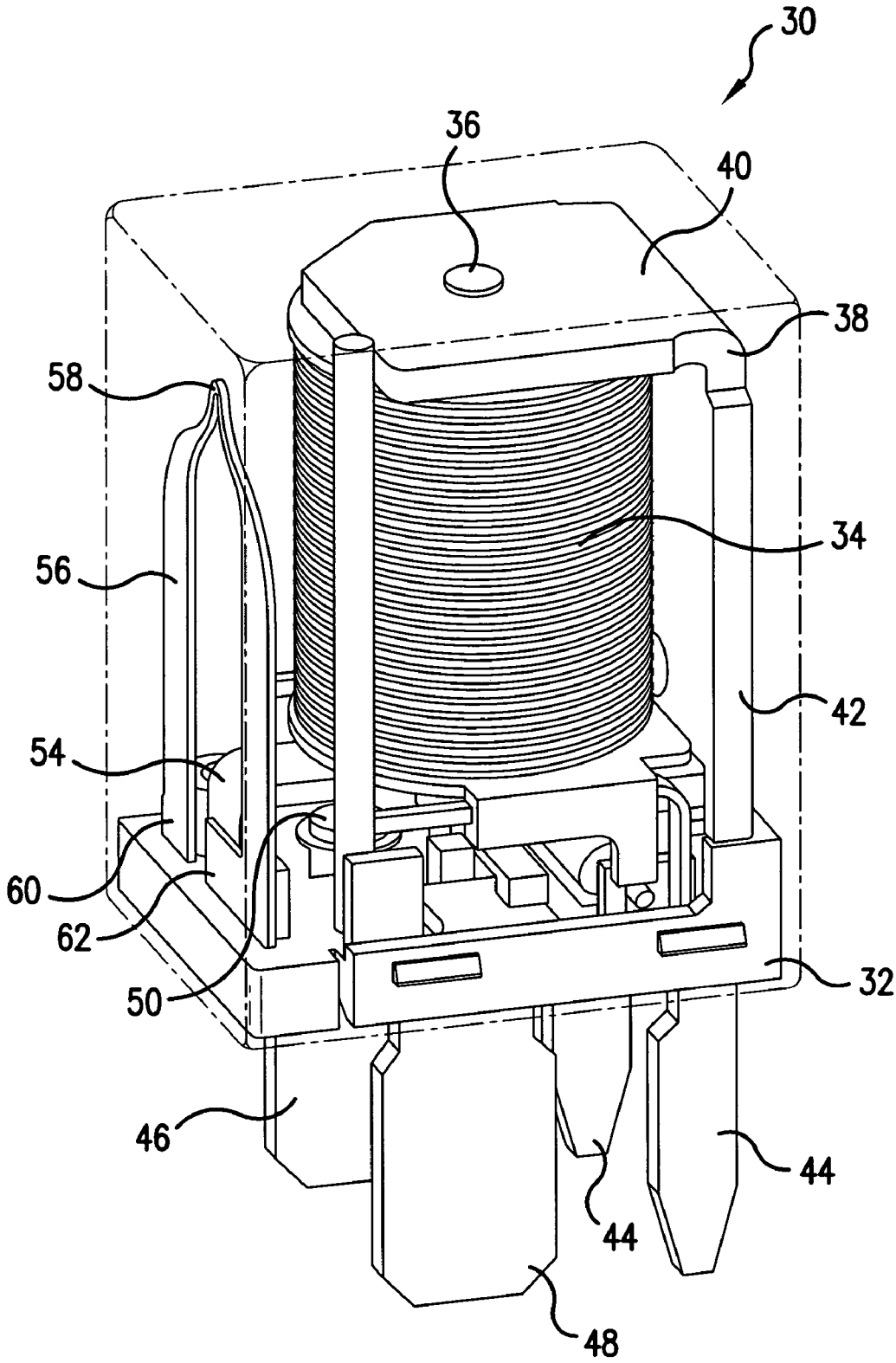

Referring to FIGS. 4 and 5 there is shown a fuse linked relay 30 that includes a base 32 that is made of an insulating material, on which are arranged a magnet system with a coil 34, a core 36 being arranged inside the coil 34, and a L-shaped yoke 38 with a first yoke leg 40 and a second yoke leg 42. An axis of the coil 34 is essentially perpendicular to a primary plane of the base 32.

The core 36 is connected to the first yoke leg 40. Coil terminals 44 are electrically connected to the coil 34 to energize the coil 34 by a remote switch (not shown). A connector terminal 46 is electrically connected to a contact terminal 52 and a connector terminal 48 is electrically connected to a movable contact terminal 50 that contacts a contact terminal 54 when the coil 34 is energized.

Between the contact terminals 52 and 54 a fuse 56 is arranged so that the fuse 56 is in series with the contact terminals 52 and 54, and thus in series with the connector terminals 46 and 48. The fuse 56 can be a melt type fuse, a resettable fuse, such as a polymeric PTC (Positive Temperature Coefficient) resettable fuse, a circuit breaker, a thermistor, or any type of circuit protecting device.

The fuse 56 shown in FIGS. 4 and 5 has a fuse link 58, which breaks (melts) depending on the current passing there through. For example, the fuse link 58 can be rated for 15 amps, 30 amps, etc. The fuse 56 is directly and non-removably connected to the contact terminals 52, 54 by, for example, welding, brazing, or riveting ends 60, 62 of the fuse 56 to the contact terminals 52, 54, respectively. In addition, bottom portions of the ends 52, 54 can be anchored to the base 32 by epoxy, press fit, or staking.

Because the ends 60, 62 of the fuse 56 are directly and non-removably connected to the contact terminals 52, 54, no heat is generated. Whereas, as noted above, approximately 3 watts of heat are generated at the contact points of the plugable fuse of the prior art. Thus, the present invention significantly reduces the amount of heat being generated by the fuse linked relay 30. For example, in a vehicle having 20 fuse linked relays 30 in a fuse box, the amount of heat that is generated is approximately 80 watts. In contrast thereto, as previously noted, the fuse and relay combinations of the prior art generate 120–180 watts of heat or more.

Figure 6:
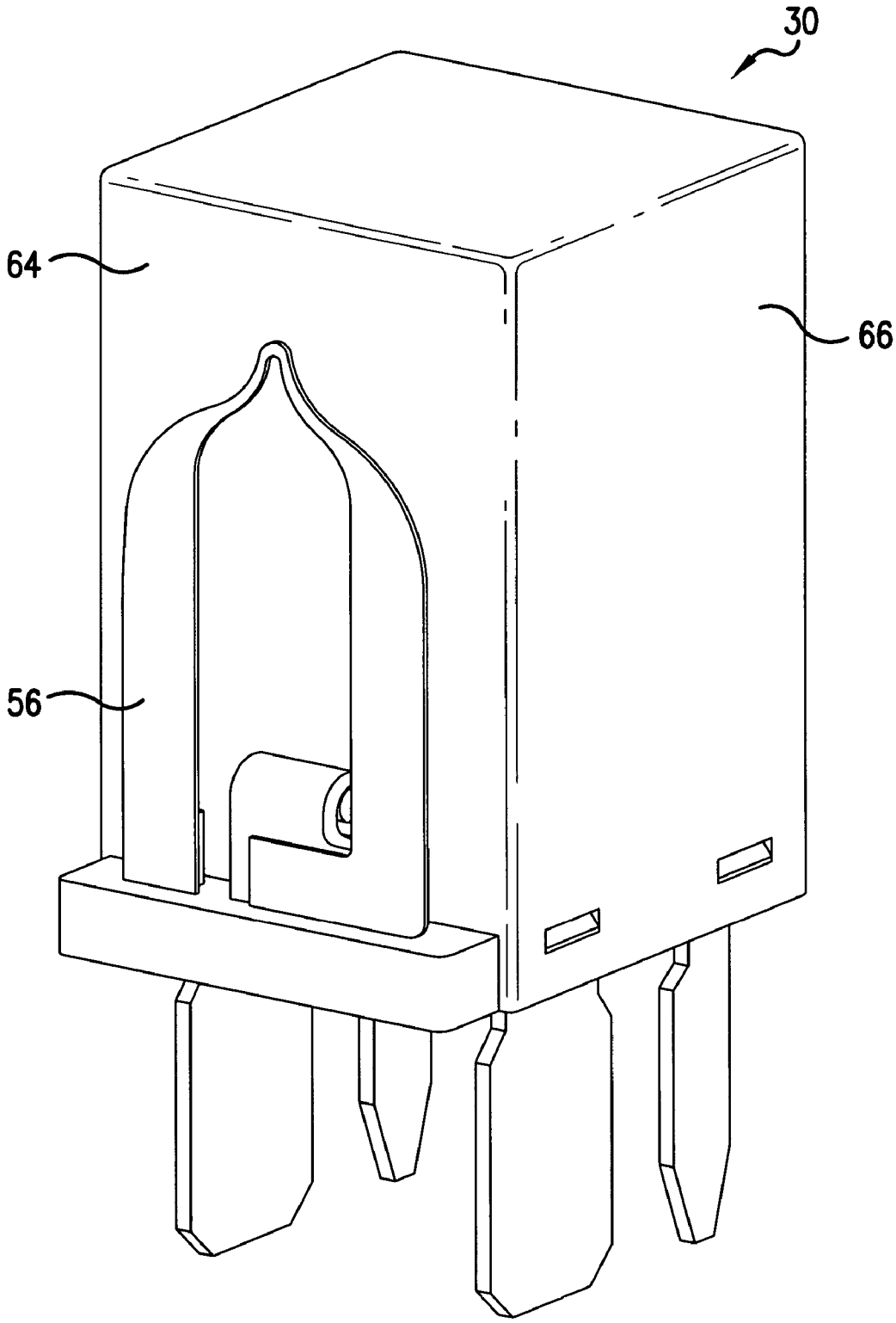
FIG. 6 is a perspective view of the fuse linked relay showing a thermally insulated wall portion according to a preferred embodiment of the present invention.

In a preferred embodiment, the fuse linked relay 30 includes a thermally insulated wall 64 that is provided between the coil 34 and the fuse 56. The thermally insulated wall 64 reduces thermal derating effects between the coil 34 and the fuse 56. The thermally insulated wall 64 can be integrally molded with the housing 66, as shown in FIG. 6, or can be a separate element that is provided between the coil 34 and the fuse 56.

Figure 7:
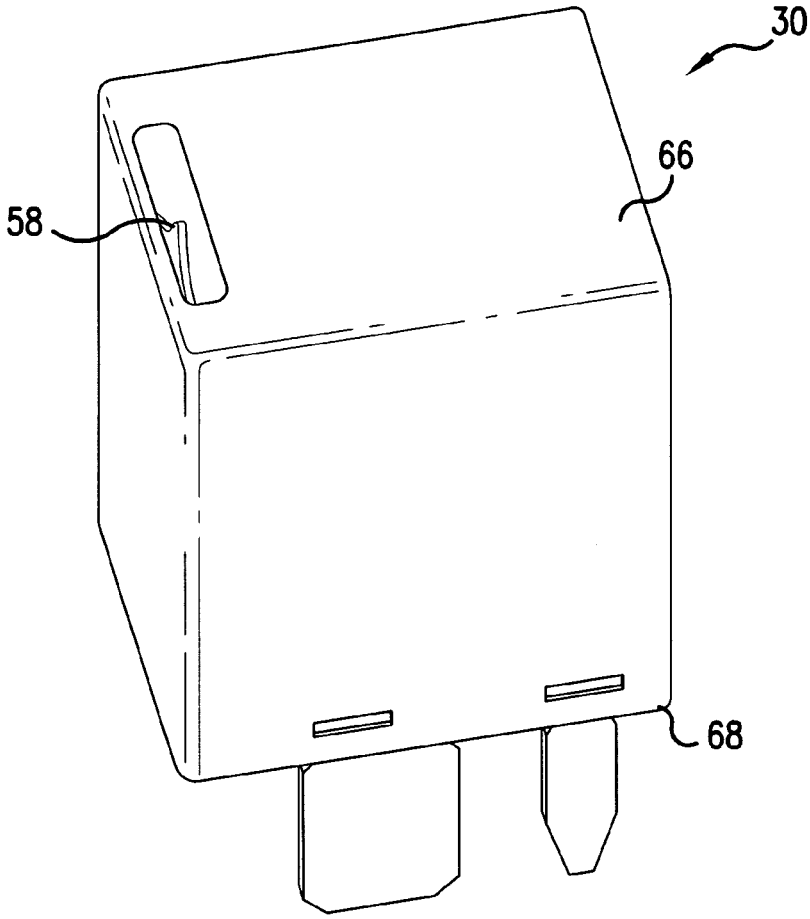
FIG. 7 is a perspective view of a housing being provided on the fuse linked relay according to a preferred embodiment.
Figure 8:
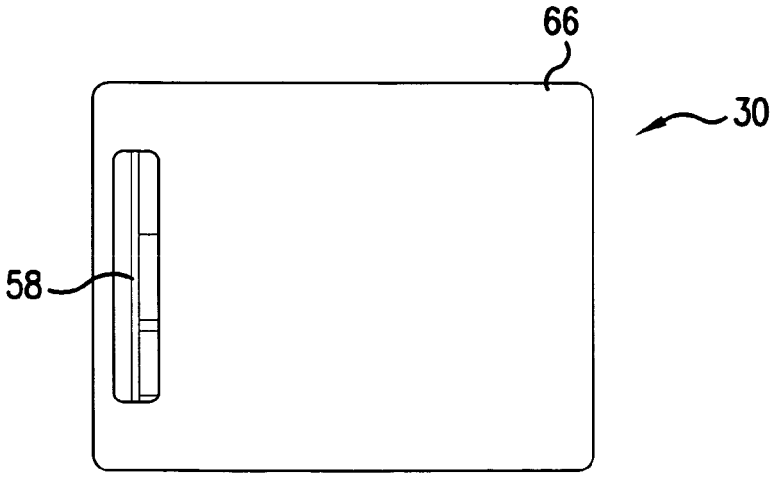
FIG. 8 is a top view of the fuse linked relay of FIG. 7.

FIGS. 7 and 8 show, in a preferred embodiment, the housing 66 encapsulating the coil 34, the yoke 38, and the fuse 56 such that a bottom edge 68 of the housing 66 of the fuse linked relay 30 contacts a circumferential edge of the base 32. The housing 66 can be attached to the base 32 by, for example, snap fit, or by any other known method. The housing 66 can be molded as one-piece or can be molded in separate sections, e.g., one section to cover the yoke 38 and coil 34 and another section to cover the fuse 58.

In a further embodiment, the housing 66 can be made of a transparent material or can be formed so as to have a transparent window 70, which can be formed on the housing 66 by a two shot molding process or can be snap fit into the housing 66. The transparent window 70 is preferably provided, for example, on a top side 72 of the housing 66, so that the fuse link 58 can viewed to determine whether or not the fuse link 58 has been disconnected, e.g. blown. It is noted that the transparent window 70, or a plurality of transparent windows 70, can be provided anywhere on the housing 66, depending on the application of the fuse linked relay 30. In addition, the transparent window 70 can be smooth or textured and can also be colored to follow the standard color association of fuses. The housing 66 can also further include an aperture (not shown) for enabling access to manually reset the fuse 56.

Figure 9:
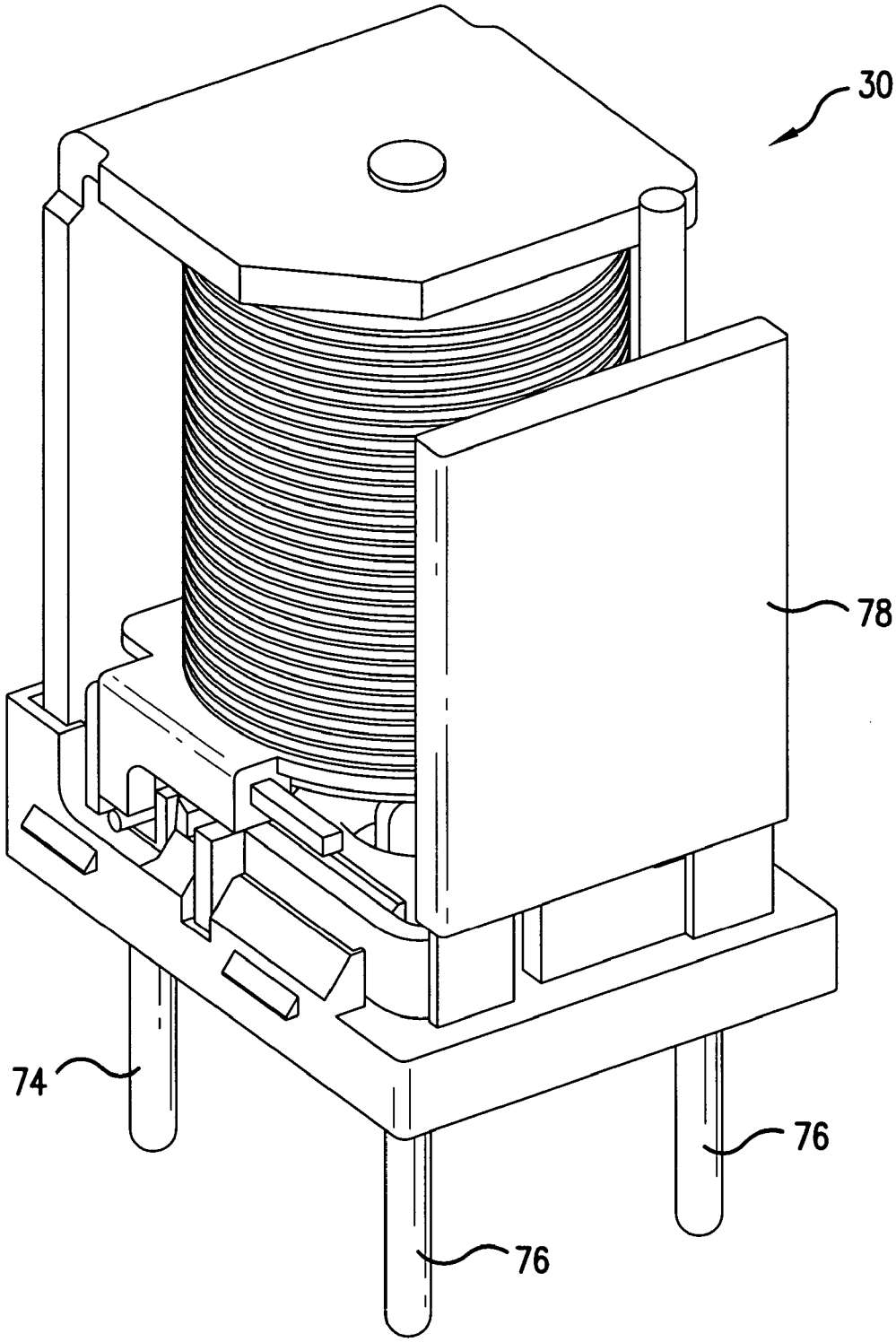
FIG. 9 is a perspective view of a fuse linked relay according to an alternate embodiment of the present invention.

FIG. 9 illustrates the fuse linked relay 30 according to an alternate embodiment, whereby the fuse linked relay 30 has its coil terminals 74 and connector terminals 76 formed as PCB (Printed Circuit Board) leads, which can be soldered, brazed, or welded, to, for example, a fuse box or a circuit board. In addition, FIG. 9 also illustrates a resettable type fuse 78, in this example, a polymeric PTC resettable fuse.

The design of the fuse linked relay 30 of the present invention allows a small package that is smaller than standard micro-relay packages, while carrying up to 40 amps or more. The fuse linked relay 30 according to the present invention also eliminates connections in a fuse box of, for example, a vehicle, which thereby reduces the heat and temperature rise in the fuse box. As such, a vehicle fuse box can be reduced by up to 70% in comparison with a conventional vehicle fuse box. Furthermore, the relay according to the present invention can be rated for Pulse Width Modulation, which further reduces the temperature rise in a fuse box.

Furthermore, the fuse linked relay 30 of the present invention, although being described with an electromagnetic coil 34, can utilize, for example, a pneumatic or hydraulic system in order to move the movable element 50 towards the contact terminal 54.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A relay comprising:

a first connector terminal being electrically connected to a first contact terminal; wherein the first contact terminal has a first flat contact surface a second connector terminal being electrically connected to a movable contact terminal, which is selectively connectable to a second contact terminal; wherein the second contact terminal has a second flat contact surface a fuse having a first flat surface end portion and a second flat surface end portion, the first flat surface end portion and the second flat surface end portion of the fuse being permanently fixedly and directly connected to the first and second flat contact surfaces of the first and second contact terminal, respectively.

2. The relay according to claim 1, wherein the first connector terminal and the second connector terminal are formed to be received in a receptacle of a fuse box.

3. The relay according to claim 1, wherein the first connector terminal and the second connector terminal are PCB leads.

4. The relay according to claim 1, wherein the first end portion and the second end portion of the fuse are fixedly and directly connected to the first contact terminal and the second contact terminal by welding, brazing, or riveting.

5. The relay according to claim 1, further comprising a coil, wherein the second contact terminal is connected to the movable element when the coil of the relay is energized.

6. The relay according to claim 1, wherein the fuse is in series with the first contact terminal and the second contact terminal.

7. The relay according to claim 1, further comprising a base, wherein the fuse is arranged onto the base.

8. The relay according to claim 1, further comprising a housing for encapsulating the fuse.

9. The relay according to claim 1, wherein the fuse has a fuse link that melts depending on current.

10. The relay according to claim 1, wherein the fuse is a resettable fuse.

11. The relay according to claim 1, wherein the relay further comprises a coil for moving said movable contact terminal.

12. The relay according to claim 5, further comprising a thermally insulating wall being provided between the fuse and the coil.

13. The relay according to claim 8, wherein the housing is formed as one piece.

14. The relay according to claim 8, wherein the housing is transparent.

15. The relay according to claim 8, wherein the housing further includes a transparent window.

16. The relay according to claim 15, wherein the transparent window is colored.

17. The relay according to claim 15, wherein the transparent window is formed on the housing in order to facilitate viewing of a fuse link of the fuse.

18. The relay according to claim 15, wherein the transparent window is provided on a top side of the housing.

19. The relay according to claim 12, wherein the thermally insulating wall is integrally molded with a housing, the housing substantially encapsulating the coil and/or the fuse.

20. The relay according to claim 10, wherein the resettable fuse is a polymeric PTC resettable fuse.

21. The relay according to claim 11, wherein the coil is electromagnetic.

* * * * *